US005988196A

United States Patent [19]

Rosenberg

[11] Patent Number: 5,988,196

[45] Date of Patent: Nov. 23, 1999

[54] CYCLICALLY-OPERATED HYDRAULIC DEVICE PARTICULARLY USEFUL AS A LIQUID PULSATORS, AND METHOD OF OPERATING SAME

[76] Inventor: Peretz Rosenberg, Moshav Beit Shearim, 30046 D.N. Haamakim, Israel

[21] Appl. No.: 08/943,034

[22] Filed: Oct. 2, 1997

[30] Foreign Application Priority Data

Oct. 4, 1996 [IL] Israel ..... 119351

[51] Int. Cl.[6] ..... F16K 51/00

[52] U.S. Cl. ..... 137/1; 137/624.14; 137/211

[58] Field of Search ..... 137/624.14, 209, 137/211, 211.5, 1

[56] References Cited

U.S. PATENT DOCUMENTS 3,981,319 9/1976 Holt ..... 137/211

4,002,184 1/1977 Tubbs et al. ..... 137/211

4,949,747 8/1990 Rosenberg ..... 137/624.14 X 5,738,136 4/1998 Rosenberg ..... 137/624.14 X

*Primary Examiner*—Kevin Lee

*Attorney, Agent, or Firm*—Benjamin J. Barish

[57] ABSTRACT

A cyclically-operated hydraulic device includes: an air-liquid chamber which, during a first part of each cycle is partially filled with a liquid while air in the chamber is compressed, and during a second part of each cycle discharges under pressure a portion of said liquid from the chamber; and an air-replenishing device which inlets a small quantity of air into the air-liquid chamber during each cycle to replenish air contained in the liquid discharged under pressure.

18 Claims, 2 Drawing Sheets

CYCLICALLY-OPERATED HYDRAULIC DEVICE PARTICULARLY USEFUL AS A LIQUID PULSATORS, AND METHOD OF OPERATING SAME

FIELD AND BACKGROUND OF THE INVENTION

The present invention relates to cyclically-operated hydraulic devices, and also to a method of operating such devices. The invention is particularly useful in liquid pulsators, such as now finding widespread use in water irrigation systems, and is therefore described below with respect to this application, but it will be appreciated that the invention could also be used in other cyclically-operated hydraulic device, such as externally-driven liquid pumps.

Pulsator devices, such as described in my Israel patents No. 74332, 88014 and 92886 (U.S. Pat. Nos. 4,781,217, 4,949,747 and 5,201,342, respectively) generally include an air-liquid chamber, an inlet having a flow-reducer for inletting the liquid into the chamber in a continuous manner at a low rate, and an outlet formed with a large orifice controlled by an outlet valve which opens at a relatively high pressure and closes at a relatively low pressure. Thus, the liquid may be continuously introduced into the air-liquid chamber at a low rate thereby increasing the pressure within the chamber, until the outlet valve opens, at which time the outlet valve discharges the liquid in the form of a pulse until the outlet valve recloses. Such pulsator devices are used in water irrigation systems to enable irrigation devices to be fed with water continuously at a relatively low rate but to discharge the water periodically in the form of pulses each pulse being at a relatively high rate.

During the operation of such pulsator devices, a small quantity of air from the air-liquid chamber is dissolved in the liquid pulse discharge from the chamber. As a result, after a relatively short period of continuous operation (e.g. about 12 hours), it is necessary to discontinue operating the pulsator device, permit it to drain, and then to be refilled with air, before resuming the continuous operation of the pulsator device.

The foregoing drawback is also present in other types of cyclically-operated hydraulic devices, such as externally-driven liquid pumps which include air-liquid chambers periodically discharging pulses of the liquid.

OBJECT AND BRIEF SUMMARY OF THE INVENTION

An object of the present invention is to provide cyclically-operated hydraulic devices of the foregoing type which may be continuously operated and which do not require periodic cessation of the operation of the device to permit the device to drain and refill with air. Another object of the invention is to provide a pulsator having the foregoing advantage. Further objects are to provide air replenishing devices which may be used with pulsators or other such types of hydraulic devices, and a still further object is to provide a method of operating such hydraulic devices.

According to one aspect of the present invention, there is provided a cyclically-operated hydraulic device including an air-liquid chamber which, during a first part of each cycle is partially filled with a liquid while air in the chamber is compressed, and during a second part of each cycle discharges under pressure a portion of the liquid from the chamber; characterized in that the device includes an air-replenishing device which inlets a small quantity of air into the air-liquid chamber during each cycle to replenish air contained in the liquid when discharged under pressure.

According to another aspect of the present invention, there is provided a cyclically-operated pulsator including an air-liquid chamber which, during a first part of each cycle is partially filled with a liquid while the air in the chamber is compressed, and during a second part of each cycle discharges a portion of the liquid from the chamber in the form of a liquid pulse; and an air replenishing device which inlets a small quantity of air into the air-liquid chamber during each cycle to replenish air contained in the liquid when discharged in the form of a liquid pulse.

It will thus be seen that the pulsator device, or other cyclically-operated hydraulic device, constructed in accordance with the present invention is replenished with a small quantity of air during each cycle of operation of the device, and therefore it is not necessary to discontinue operation of the device after relatively short periods of time in order to permit the device to drain and to be refilled with air.

According to a still further aspect of the present invention, there is provided an air replenishing device attachable to a pulsator, or other cyclically-operated hydraulic device including an air-liquid chamber which, during a first part of each cycle is partially filled with a liquid while the air in the chamber is compressed, and during a second part of each cycle discharges a portion of the liquid from the air-liquid chamber in the form of a pressure pulse; the air replenishing device inletting a small quantity of air into the air-liquid chamber during each cycle to replenish air contained in the liquid when discharged under pressure. The air replenishing device comprises: a housing including a displaceable member dividing the interior of the housing into an expansible-contractable liquid chamber communicating via a first passageway with the air-liquid chamber of the pulsator or other hydraulic device, and an expansible-contractable air chamber communicating via a second passageway with ambient air; a first one-way valve in the first passageway permitting one-way air flow from the air chamber into the liquid chamber; and a second one-way valve in the second passageway permitting one-way flow of ambient air into the air chamber.

According to a still further aspect of the present invention, there is provided a method of operating a pulsator or other cyclically-operated hydraulic device including an air-liquid chamber which, during a first part of each cycle is partially filled with a liquid while air in the chamber is compressed, and during a second part of each cycle discharges a portion of the liquid from the air chamber in the form of a pressure pulse; the method comprising inletting a small quantity of air into the air-liquid chamber during each cycle to replace air contained in the liquid when discharged under pressure.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
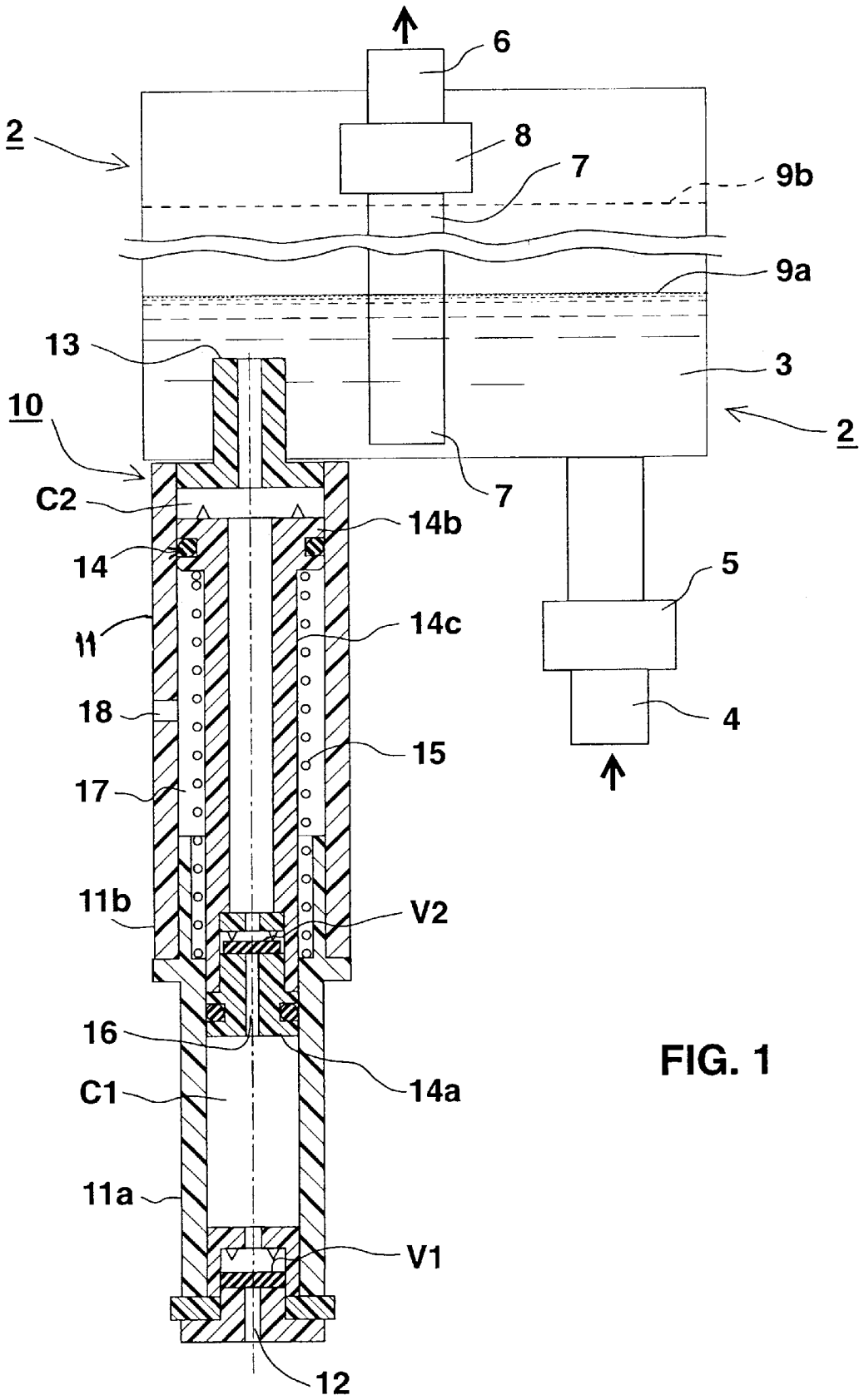
FIG. 1 illustrates a pulsator including an air replenishing device constructed in accordance with the present invention, the air replenishing device being shown in its condition at the low-pressure stage of the pulsator.

The pulsator device, generally designated 2 in the drawings, may be any of the known types, e.g. as described in one of my prior patents set forth above. Such a pulsator device includes an air-liquid chamber 3 having an inlet 4 for inletting liquid, particularly water, at a continuous low rate as controlled by a flow-reducer 5. The pulsator device further includes an outlet 6 communicating with the lower end of chamber 3 via a feed tube 7. The outlet 6 is controlled by a valve 8 which is normally closed, opens at a predetermined high pressure, and recloses at a predetermined low pressure. Thus, with valve 8 normally closed, the water is fed via the inlet 4 continuously at a low rate via flow reducer 5 into chamber 3, thereby building-up the pressure within chamber 3, until the presure is sufficiently large to cause valve 8 to open, whereupon a pulse of the liquid is discharged via outlet 6 causing valve 8 to reclose preparatory to the build-up of pressure within chamber 3 for discharging another pulse of the water.

Since any of the known pulsators may be used for pulsator 2 illustrated in the drawings, further details of the construction and operation of such a pulsator are not set forth herein but are available in the published prior art, e.g. my two patents cited above.

Figure 2:
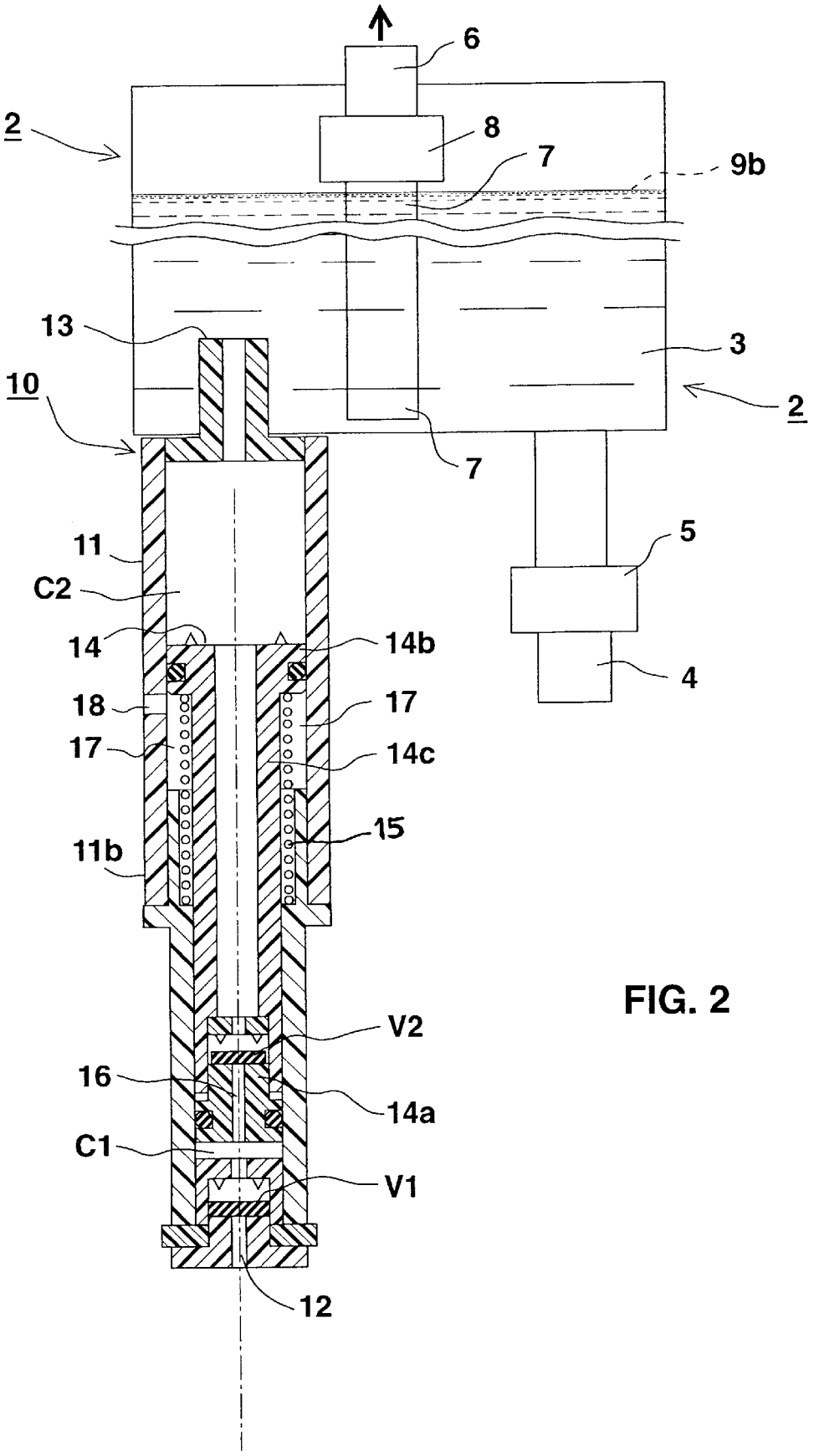
FIG. 2 is a view similar to that of FIG. 1 but illustrating the condition of the air replenishing device at the high-pressure stage of the pulsator.

It will thus be seen that the pulsator 2 illustrated in the drawings is cyclically operated to discharge a pulse of the water during each cycle. FIG. 1 illustrates the low-pressure condition of the pulsator just after it has discharged a pulse of the water, such that the water within chamber 3 is at the low level indicated at 9*a*; while FIG. 2 illustrates the high-pressure condition of the pulsator device, just before discharging a pulse of water, so that the water is at the high level 9*b* in the pulsator chamber 3.

As briefly described earlier, during each operation of the pulsator device a small quantity of air within chamber 3 is contained in the water pulse discharged from that chamber via the outlet 6. As a result, the operation of the pulsator must be periodically interrupted to permit draining and refilling its chamber 3 with air, before the operation can be resumed.

In order to avoid the need for periodically interrupting the operation of the pulsator, it is provided with an air-replenishing device, generally designated 10, which inlets a small quantity of air into the air-liquid chamber 3 of the pulsator during each cycle of operation to replenish the air contained in the water when discharged from chamber 3 in the form of a water pulse.

The air replinishing device 10 includes a housing 11 having an inlet 12 communicating with the ambient air, and an outlet 13 communicating with the air-liquid chamber 3 of the pulsator 2. Housing 11 is constituted of a small-diameter section 11*a* formed with the inlet 12 at one end, and with a larger-diameter section 11*b* formed with the outlet 13 at the opposite end. The two sections 11*a*, 11*b* are attached together in any suitable manner, e.g. by a friction fit.

A piston assembly, generally designated 14, is displaceable within housing 11. Piston assembly 14 includes a piston head 14*a* movable within housing section 11*a*, a piston head 14*b* movable within housing section 11*b*, and a hollow stem 14*c* connecting piston head 14*a* to piston head 14*b*. The interior of housing 11 is thus divided by piston head 14*a* into a first chamber $C_1$ and a second chamber $C_2$. Chamber $C_1$ communicates with the ambient-air inlet 12 and is therefore an air chamber, whereas chamber $C_2$ communicates with the lower end of pulsator chamber 3 which is always filled with a liquid (water), and is therefore a liquid chamber. Piston head 14*a* is formed with an axial passageway 16 therethrough to establish communication between chambers $C_1$ and $C_2$. The annular space 17 between piston stem 14*c* and housing section 11*b* is vented to the atmosphere via a vent opening 18 through housing section 11*b*.

It will be seen that both chambers $C_1$ and $C_2$ are expansible-contractable chambers by the displacement of the piston assembly 14. Thus, when piston assembly 14 is in its upper position as illiustrated in FIG. 1, air chamber $C_1$ is expanded and liquid chamber $C_2$ is contracted; whereas when piston assembly 14 is in its lower position as illustrated in FIG. 2, air chamber $C_1$ is contracted and the liquid chamber $C_2$ is expanded. A spring 15 normally urges piston assembly 14 to its upper position illustrated in FIG. 1 wherein air chamber $C_1$ is expanded.

Air chamber $C_1$ communicates with the ambient air via opening 12 by means of a one-way valve $V_1$, which valve permits the one-way flow of air into the air chamber $C_1$. Thus, when air chamber $C_1$ is being expanded, valve $V_1$ permits the air to be drawn via inlet 12 into chamber $C_1$ (FIG. 1); but when air chamber $C_1$ is being contracted (FIG. 2), valve $V_1$ blocks the exit of air from that chamber via the inlet opening 12.

Air chamber $C_1$ communicates with liquid chamber $C_2$ via a second one-way valve $V_2$, which permits the one-way flow of air from air chamber $C_1$ into liquid chamber $C_2$. Thus, when chamber $C_2$ is being expanded, air from chamber $C_1$ is drawn into the liquid in chamber $C_2$; but when chamber $C_2$ is being contracted, the liquid within that chamber is blocked from flowing into air chamber $C_1$.

The illustrated pulsator 2, including the air replenishing device 10, operates as follows:

FIG. 1 illustrates the low-pressure condition of pulsator 2, i.e. just after valve 8 has opened and closed to discharge a pulse of water so that the water within chamber 3 is at its low level 9*a*. FIG. 1 also illustrates the condition of the air replinishing device 10, wherein it will be seen that the liquid chamber $C_2$ communicating with pulsator chamber 3 is in its contracted condition because the low pressure within pulsator chamber 3 is insufficient to overcome the force of spring 15; whereas air chamber $C_1$ is in its expanded condition.

Since valve 8 is closed at this instant, the water inletted into pulsator chamber 3 at a slow continuous rate via flow reducer 5 gradually builds up the pressure within the pulsator chamber 3. That pressure is communicated to chamber $C_2$ of the air replenishing device 10, thereby moving piston assembly 14 downwardly to enlarge chamber $C_2$, and by the same token, to contract chamber $C_1$. During this contraction of chamber $C_1$, valve $V_1$ closes inlet 12, whereas valve $V_2$ opens passageway 16 through valve head 14*a* between chambers $C_1$ and $C_2$. Thus, during this contraction of chamber $C_1$, the air within chamber $C_1$ is blocked from exiting from the replenishing device via outlet 12, but is permitted to flow via passageway 16 into chamber $C_2$.

As the water is continuously inletted into pulsator chamber 3, the water level within that chamber continuously rises. This continuously increases the pressure within chamber 3, until the water reaches the high level 9*b*. At this level, the pressure within pulsator chamber 3 is sufficient to open valve 8, to produce another discharge of water from chamber 3.

FIG. 2 illustrates the condition of the air replenishing device 10 just before valve 8 opens. In this condition, air chamber $C_1$ is fully contracted, and the liquid chamber $C_2$ is fully expanded.

As soon as valve 8 opens to discharge a pulse of water via outlet 6, the water within pulsator chamber 3 immediately drops to the level indicated at 9*a*. This resulting lower pressure within pulsator chamber 3 causes spring 15 to move piston assembly 14 to the condition illustrated in FIG. 1, wherein chamber $C_2$ is again contracted, and chamber $C_1$ is again expanded. The contraction of chamber $C_2$ injects the liquid within that chamber, as well as the small quantity of air which was previously received from chamber $C_1$, into the pulsator chamber 3 since one-way valve $V_2$ closes passageway 16; whereas the expansion of chamber $C_1$ draws into it additional ambient air via inlet 12 which is opened by the one-way valve $V_1$.

The one-way valves $V_1$, $V_2$, are preferably freely-movable valve members having resilient or elastomeric faces on one side for closing the passageway on that side (e.g. 12, 16, respectively), and rigid surfaces on the opposite side engageable with prong-type spacer elements to prevent closing the passageway on the opposite side. However, other one-way valve constructions may be used for valves $V_1$, $V_2$.

It will thus be seen that with each cyclical operation of pulsator 2, a small quantity of air is injected into pulsator chamber 3 by the air replenishing device 10, thereby replenishing the small quantity of air discharged from pulsator chamber 3 with each discharged water pulse. Accordingly, the pulsator may be operated continuously over long periods of time without the need to interrupt its operation in order to drain it and refill its chamber 3 with air.

While the invention has been described with respect to one preferred embodiment, it will be appreciated that this is set forth merely for purposes of example. Thus, the air replenishing device 10 could use another displaceable member, such as a diaphragm, instead of piston assembly 14. Also, the air replenishing device 10 could be used with other cyclically-operated hydraulic devices, such as externally-driven liquid pumps, of the type which include an air-liquid cylinder from which a liquid pulse is cyclically discharged.

Many other variations, modifications and applications of the invention will be apparent.

I claim:

1. A cyclically-operated hydraulic device operating in a plurality of cycles and including an air-liquid chamber which, during a first part of each cycle is partially filled with a liquid while air in the chamber is compressed, and during a second part of each cycle discharges under pressure a portion of said liquid from the chamber; characterized in that said hydraulic device includes an air-replenishing device which inlets a small quantity of air into said air-liquid chamber during each cycle to replenish air contained in said liquid discharged under pressure.

2. The device according to claim 1, wherein said air replenishing device comprises;

a housing including a displaceable member dividing the interior of the housing into an expansible-contractable liquid chamber communicating via a first passageway with said air-liquid chamber of the hydraulic device, and an expansible-contractable air chamber communicating via a second passageway with ambient air;

a first one-way valve in said first passageway permitting one-way air flow from said air chamber into said liquid chamber;

and a second one-way valve in said second passageway permitting one-way flow of ambient air into said air chamber.

3. The device according to claim 2, wherein said displaceable member is a piston.

4. The device according to claim 2, wherein said liquid chamber and said air chamber are located coaxially at opposite ends of said housing.

5. The device according to claim 4, wherein said liquid chamber is of larger cross-sectional area than said air chamber.

6. The device according to claim 1, wherein said hydraulic device is a liquid pulsator which includes an inlet having a flow-reducer inletting the liquid into said air-liquid chamber at a low rate, an outlet for discharging the liquid from the air-liquid chamber at a high rate, and a valve assembly between said air-liquid chamber and said outlet, which valve assembly (a) is normally closed to permit a build-up of pressure within the air-liquid chamber as liquid is inletted thereinto at a low rate, (b) opens at a predetermined high pressure to discharge a pulse of the liquid from the air-liquid chamber, and (c) recloses at a predetermined pressure lower than said predetermined high pressure to permit another build-up of pressure within the air-liquid chamber for discharging another pulse of the liquid.

7. A cyclically-operated pulsator operating in a plurality of cycles and including an air-liquid chamber which, during a first part of each cycle is partially filled with a liquid while the air in the chamber is compressed, and during a second part of each cycle discharges a portion of said liquid from the chamber in the form of a liquid pulse;

and an air replenishing device which inlets a small quantity of air into said air-liquid chamber during each cycle to replenish air contained in said liquid when discharged in the form of a liquid pulse.

8. The pulsator according to claim 7, wherein the pulsator includes an inlet having a flow-reducer inletting the liquid into the air-liquid chamber at a low rate, an outlet for discharging the liquid from the air-liquid chamber at a high rate, and a valve assembly between said air-liquid chamber and said outlet, which valve assembly (a) is normally closed to permit a build-up of pressure within the air-liquid chamber as liquid is inletted there into at a low rate, (b) opens at a predetermined high pressure to discharge a pulse of the liquid from the air-liquid chamber, and (c) recloses at a predetermined pressure lower than said predetermined high pressure to permit another build-up of pressure within the air-liquid chamber for discharging another pulse of the liquid.

9. The pulsator according to claim 7, wherein said air replenishing device comprises;

a housing including a displaceable member dividing the interior of the housing into an expansible-contractable liquid chamber communicating via a first passageway with said air-liquid chamber of the hydraulic device, and an expansible-contractable air chamber communicating via a second passageway with ambient air;

a first one-way valve in said first passageway permitting one-way air flow from said air chamber into said liquid chamber;

and a second one-way valve in said second passageway permitting one-way flow of ambient air into said air chamber.

10. The pulsator according to claim 9, wherein said displaceable member is a piston.

11. The pulsator according to claims 9, wherein said liquid chamber and said air chamber are located coaxially at opposite ends of said housing.

12. The pulsator according to claim 11, wherein said liquid chamber is of larger cross-sectional area than said air chamber.

13. An air replenishing device attachable to a cyclically-operated hydraulic device operating in a plurality of cycles and including an air-liquid chamber which, during a first part of each cycle is partially filled with a liquid while the air in the chamber is compressed, and during a second part of each cycle discharges a portion of said liquid from the air-liquid chamber in the form of a pressure pulse; said air replenishing device inletting a small quantity of air into said air chamber during each cycle to replenish air contained in said liquid when discharged under pressure, said air replenishing device comprising:

a housing including a displaceable member dividing the interior of the housing into an expansible-contractable liquid chamber communicating via a first passageway with said air-liquid chamber of the hydraulic device, and an expansible-contractable air chamber communicating via a second passageway with ambient air;

a first one-way valve in said first passageway permitting one-way air flow from said air chamber into said liquid chamber;

and a second one-way valve in said second passageway permitting one-way flow of ambient air into said air chamber.

14. The air replenishing device according to claim 13, wherein said displaceable member is a piston.

15. The air replenishing device according to claim 13, wherein said liquid chamber and said air chamber are located coaxially at opposite ends of said housing.

16. The air replenishing device according to claim 15, wherein said liquid chamber is of larger cross-sectional area than said air chamber.

17. A method of operating a cyclically-operated hydraulic device operating in a plurality of cycles and including an air-liquid chamber which, during a first part of each cycle is partially filled with a liquid while air in the chamber is compressed, and during a second part of each cycle discharges a portion of said liquid from the air chamber in the form of a pressure pulse; said method comprising inletting a small quantity of air into said air-liquid chamber during each cycle to replace air contained in said liquid when discharged under pressure.

18. The method according to claim 17, wherein said cyclically-operated hydraulic device is a liquid pulsator including an inlet having a flow-reducer for inletting the liquid into the air-liquid chamber at a low rate, an outlet for discharging the liquid from the air-liquid chamber at a high rate, and a valve assembly between said air-liquid chamber and said outlet, which valve assembly (a) is normally closed to permit a build-up of pressure within the air-liquid chamber as liquid is inletted thereinto at a low rate, (b) opens at a predetermined high pressure to discharge a pulse of the liquid from the air-liquid chamber, and (c) recloses at a predetermined pressure lower than said predetermined high pressure to permit another build-up of pressure within the air-liquid chamber for discharging another pulse of the liquid.

* * * * *